US005832827A

United States Patent [19]

Pistro et al.

[11] Patent Number: 5,832,827

[45] Date of Patent: Nov. 10, 1998

[54] METHOD FOR PRINTING UPON LENERLESS THERMAL TRANSFER LABELS HAVING A SILICONE RELEASE AGENT

[75] Inventors: Steve J. Pistro, Willamsville, N.Y.; Xin Chen, Westborough, Mass.

[73] Assignee: Moore Business Forms, Inc., Grand Island, N.Y.

[21] Appl. No.: 893,703

[22] Filed: Jul. 11, 1997

Related U.S. Application Data

[63] Continuation of Ser. No. 480,803, Jun. 7, 1995, abandoned.

[51] Int. Cl.[6] ..... B41F 1/08

[52] U.S. Cl. ..... 101/288; 400/120.01; 400/621; 347/201; 101/483

[58] Field of Search ..... 101/288, 224, 101/483, 486; 400/621, 120.01; 347/171, 200, 201

[56] References Cited

U.S. PATENT DOCUMENTS

| | | | |
|---|---|---|---|
| 4,828,408 | 5/1989 | Bekker-Madsen et al. | 400/120 |
| 4,851,383 | 7/1989 | Fickenscher et al. | 503/200 |
| 4,968,996 | 11/1990 | Ebihara et al. | 346/76 |
| 5,077,564 | 12/1991 | Thomas | 346/76 |
| 5,081,471 | 1/1992 | Thomas | 346/76 |
| 5,089,350 | 2/1992 | Talvalkar et al. | 428/484 |
| 5,308,681 | 5/1994 | Taki et al. | 438/195 |
| 5,395,174 | 3/1995 | Koch et al. | 400/611 |
| 5,395,676 | 3/1995 | Taka et al. | 428/195 |
| 5,437,228 | 8/1995 | Uland | 101/288 |
| 5,478,880 | 12/1995 | Shipston et al. | 524/527 |
| 5,487,337 | 1/1996 | Uland | 101/288 |
| 5,497,701 | 3/1996 | Uland | 101/288 |
| 5,514,524 | 5/1996 | Ohnishi et al. | 347/201 |
| 5,524,996 | 6/1996 | Carpenter et al. | 400/621 |
| 5,666,149 | 9/1997 | Takeuchi et al. | 347/201 |

FOREIGN PATENT DOCUMENTS

| | | |
|---|---|---|
| 2144487 | 3/1996 | Canada . |
| 0 579 430 A1 | 1/1994 | European Pat. Off. . |
| 0700 791 A1 | 3/1996 | European Pat. Off. . |

*Primary Examiner*—Christopher A. Bennett
*Attorney, Agent, or Firm*—Finnegan Henderson et al.

[57] ABSTRACT

A method of printing on a release layer of linerless label material including the step of advancing linerless label material and a thermal transfer ribbon coated with ink through a thermal printer. The ribbon is moved over a heated transfer element of the printer. The heated transfer element is located on an edge or on a corner of an edge of the thermal printer. The ribbon is then heated to cause the ink to reach a molten or fluid state. The ink transfers in its molten or fluid state to the release layer of the linerless label material. Certain wax/resin and resin based thermal transfer ribbons and silicone release coatings have been found to be particularly effective for increasing the ink transfer and anchorage during corner edge and true edge printing on linerless label material.

39 Claims, 2 Drawing Sheets

METHOD FOR PRINTING UPON LENERLESS THERMAL TRANSFER LABELS HAVING A SILICONE RELEASE AGENT

This application is a continuation of application Ser. No. 08/480,803, filed Jun. 7, 1995, now abandoned.

BACKGROUND OF THE INVENTION

1. Field of the Invention

The present invention relates generally to linerless thermal transfer labels and methods of printing on the same. In particular, the invention relates to a method of printing that enables improved transfer and anchorage of ink to release layers on linerless labels.

2. Description of the Related Art

Conventional linered thermal transfer labels include a substrate, with or without an ink receptive top layer and with or without an underlayer primarily for curl control and adhesive anchorage. An adhesive back layer is covered by a backing paper. The backing paper typically includes a silicone release agent to facilitate removal of the backing paper from the label.

The final step in manufacturing linered thermal labels includes either fanfolding the labels in a continuous stack, sheeting the labels, or winding a continuous strip of labels into a roll for storage and subsequent use. The backing paper, which is ultimately a waste product, represents a large portion of the roll size and weight, increasing costs associated with shipping, storage, and handling, and presenting environmental and disposal problems.

The advent of linerless labels alleviated many of these problems. A typical linerless label includes a substrate, an ink receptive top layer with a silicone release, and an adhesive bottom layer. Thus, the under surface of the label has an adhesive while the upper surface has a release coating. This structure allows the label to be rolled onto itself, eliminating the costs and waste associated with linered labels.

It is often desirable to print various indicia onto labels. Printing on linered thermal transfer labels is carried out by passing a thermal transfer ribbon under the printhead. Portions of the wax or resin based ink coating transfer to the substrate to define an image. The transferred ink comes into contact with paper fibers and partly absorbs or anchors into the substrate thereby preventing the printed indicia from coming off.

Thermal printing on linerless thermal transfer labels typically occurs by transferring ink from a thermal transfer ribbon onto the surface coated with the release material. This presents problems because the release layer provides little or no anchorage of the ink material. Thus, the ink does not absorb into the substrate, if in fact it transfers at all, and essentially sits on the release layer surface where it is easily smeared or scratched off.

In addition, thermal transfer printing is usually accomplished through the use "near edge" printheads, which will be described in more detail herein. Such printing occurs over a flat surface where the printing points heat up the ribbon. The ink transfer thus occurs over a relatively large distance, typically two millimeters from the point of heat application. When printing upon a silicone release material, this has the effect of causing the ink to re-cool and either not transfer from the ribbon at all or transfer back to the ribbon. Moreover, conventional methods of printing upon a silicone containing material by a near edge printhead do not result in a suitable balance of printing properties, including image density, image definition, and resistance to smearing or scratching off.

Accordingly, there is a need for a method of thermal transfer printing that enables images to be transferred to release coatings on linerless labels wherein the images are not easily smeared or scratched off.

SUMMARY OF THE INVENTION

The present invention is directed to a method of printing on a linerless label material that alleviates many of the aforementioned drawbacks. In particular, the method according to the present invention results in improved ink transfer from the ribbon, improved image definition, and improved ink anchorage to the silicone release layer of linerless labels. The method also allows for the relatively easy peel of either a permanent or removable pressure sensitive adhesive from a linerless label roll.

To achieve the objects and in accordance with the purpose of the invention, as embodied and broadly described herein, the invention comprises a method of printing on linerless label material. The linerless label material has a substrate with an adhesive layer on a first side and a release layer on a second side. The inventive method includes the step of advancing the linerless label material and a thermal transfer ribbon coated with ink through a thermal printer. The ribbon is moved over a heated transfer element of the thermal printer. The heated transfer element is located on an edge of the thermal printer. The ribbon is heated to cause the ink to reach a molten or fluid state. The ink transfers in its molten or fluid state to the release layer of the linerless label material.

Another method according to the invention includes printing on linerless label material having a substrate with an adhesive layer on a first side and a release layer on a second side. The method includes the step of advancing the linerless label material and a thermal transfer ribbon coated with ink through a thermal printer. The ribbon is moved over a heated transfer element of the thermal printer. The heated transfer element is located on a corner of an edge of the thermal printer. The ribbon is heated to cause the ink to reach a molten or fluid state. The ink transfers in its molten or fluid state to the release layer of the linerless label material.

The invention is further directed to a linerless label having a substrate with an adhesive layer on a first side and a silicone release layer on a second side. The label is prepared by a process that includes the step of advancing the linerless label and a resin based thermal transfer ribbon coated with ink through a thermal printer. The ribbon and the linerless label are moved over a heated transfer element of the thermal printer. The heated transfer element is on an edge or on a corner of an edge of the thermal printer. The ribbon is heated to cause the ink to reach a molten or fluid state. The ink transfers in its molten or fluid state to the release layer of the linerless label.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

It is to be understood that both the foregoing general description and the following detailed description are exemplary and explanatory only and are not restrictive of the invention, as claimed.

The accompanying drawings, which are incorporated in and constitute a part of this specification, illustrate embodiments of the invention and together with the description, serve to explain the principles of the invention.

DESCRIPTION OF THE PREFERRED EMBODIMENT

Reference will now be made in detail to the present preferred embodiments of the invention, examples of which are illustrated in the accompanying drawings. Wherever possible, the same reference numbers will be used throughout the drawings to refer to the same or like parts.

The present invention is directed towards a method of printing on a release coating of a linerless label. The method uses particular types of silicone release coatings and thermal transfer ribbons during "true edge" or "corner edge" printing, as opposed to the more commonly used "near edge" printing.

The near edge design is the most commonly used printhead in both color and bar code printers. In conventional near edge printing, the heated transfer element is near the edge of the thermal printhead, but not on the edge. The transfer of ink occurs over a relatively large distance of approximately two millimeters from the point of heat application. As a result, ribbon inks tend to cool by the time the ribbon is stripped from the paper, preventing the efficient transfer of ink onto a silicone coated surface. An example of a conventional near edge printhead will be described in more detail herein.

True edge and corner edge printheads place the printing points from heated transfer elements on the edge and on the corner of the edge of the printhead, respectively, transferring the ink from the ribbon to the substrate in a contact distance between about 0.2 to about 0.5 millimeters. This significantly reduced distance as compared to that of conventional near edge printing lessens the possibility of ink resolidifying and not transferring from the ribbon. An example of both true edge and corner edge printheads will also be described in more detail further herein.

In addition to the use of corner edge and true edge printheads, the method of printing according to the present invention preferably uses resin or wax/resin based thermal transfer ribbons, as compared to more conventional wax based materials, to increase ink anchorage as well as the resistance of the ink to smearing or scratching off.

Resin and wax/resin based thermal transfer ribbons preferred for use in the present invention contain 5–25% and 50–75% wax, respectively. In contrast, typical wax ribbons contain as much as 85% wax. The pigment concentration typically is 5–20% in all cases, with resin materials comprising the balance of the ribbon composition.

Moreover, certain silicone release materials have been found particularly effective when used in combination with such wax/resin or resin based ribbons during true edge or corner edge printing. The preferred characteristics of the ribbons and release materials will be described in more detail herein.

Figure 1:
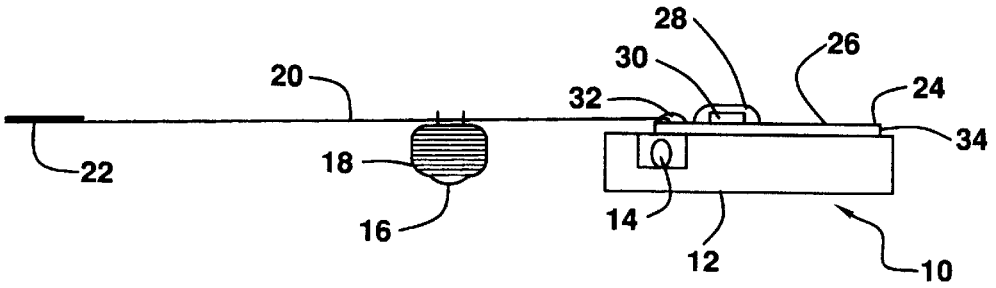
FIG. 1 is a side elevation of a conventional near edge thermal printhead.
Figure 3:
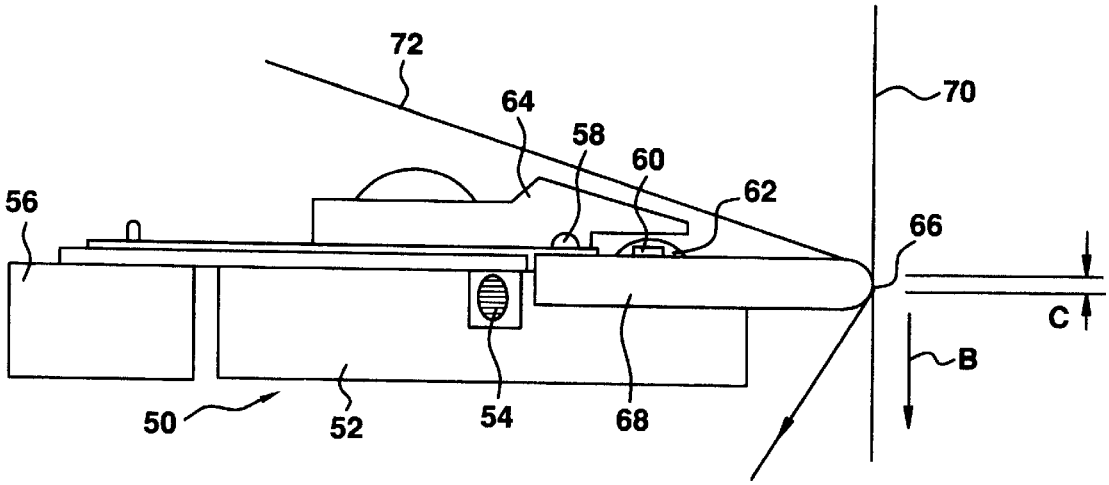
FIG. 3 is a side elevation of a true edge printhead used in a method according to the present invention and showing a thermal transfer ribbon and linerless label material.
Figure 4:
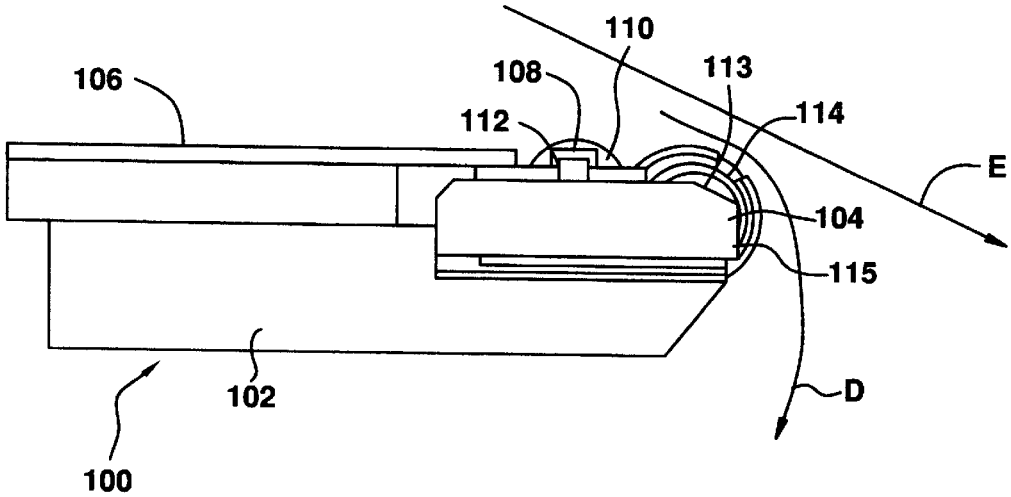
FIG. 4 is a side elevation of a corner edge printhead used in a method according to the present invention and showing a thermal transfer ribbon and linerless label material.

FIGS. 1, 3, and 4, respectively, illustrate conventional "near edge," "true edge," and "corner edge" thermal printheads. With specific reference to FIG. 1, near edge printhead 10 includes a heatsink 12, typically of aluminum, a thermistor 14, capacitors 16 and 18, a flex circuit 20, and a tab connector 22. An epoxy overcoat 28 overlies a driver IC 30. A second epoxy overcoat 32 connects flex circuit 20 to a ceramic substrate 26. A heated transfer element 24 lies on ceramic substrate 26 near an edge 34 of the printhead substrate 26. Typically, heated transfer element 24 is approximately two millimeters from edge 34.

Figure 2:
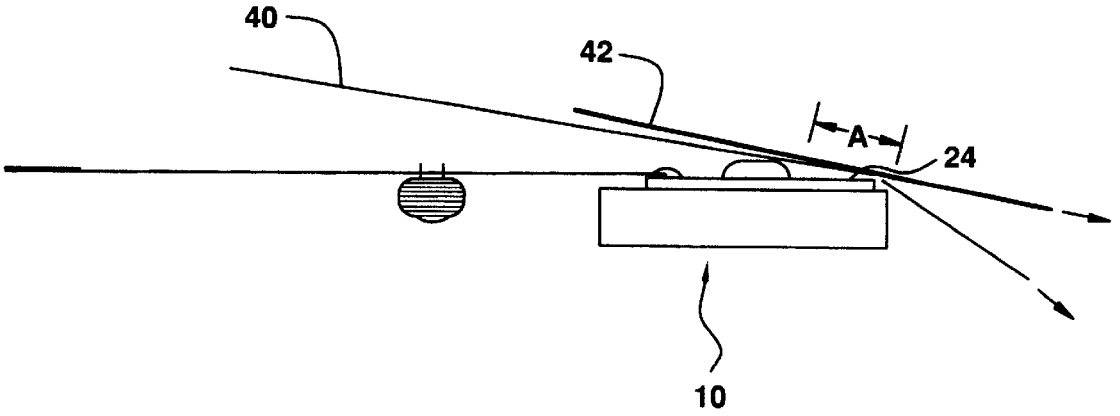
FIG. 2 is another side elevation of a conventional near edge thermal printhead showing the thermal transfer ribbon and linerless label material.

FIG. 2 shows the operation of printhead 10. As shown, a thermal transfer ribbon 40 and linerless label material 42 pass over heated transfer element 24 in the direction of the arrows. As mentioned earlier, the transfer of ink occurs over a relatively large distance of approximately two millimeters, as depicted by distance A. This large contact distance has a tendency to cause ink to transfer back to the ribbon.

In addition, the driver integrated circuits of near edge printheads typically create a nonlinear material path. The material used in near edge printing, therefore, must be pliable.

The true edge printhead, an embodiment of which is shown in FIG. 3, is a more effective printhead than the near edge printhead. True edge printhead 50 includes a heat sink 52, a thermistor 54, a connector 56, and a silicon gasket 58. A driver IC 60 is covered by an epoxy overcoat 62 and an IC coverplate 64. Heated transfer element 66 is deposited on a rounded edge of a substrate 68. The substrate 68 hangs over the edge of heat sink 52.

In the construction shown in FIG. 3, the edge of substrate 68 is rounded off. Flat true edge designs are also known in the art. True edge printheads are more expensive and difficult to manufacture due to the cost and difficulty in applying a ceramic substrate across a small surface and achieving flatness across the width of flat true edge designs.

True edge printheads, however, offer significant advantages. The linerless label material, denoted by reference numeral 70 in FIG. 3, travels along a linear path, as shown by arrow B. True edge printheads, therefore, are suitable for printing upon nonpliable surfaces, for example, plastic cards, intelligent RAM cards, and other hard surfaces.

With true edge printheads, the transfer of ink from the thermal transfer ribbon, such as thermal transfer ribbon 72 in FIG. 3, occurs in a transfer distance between about 0.2 and about 0.5 millimeters, as shown by distance C. This significant reduction in the area of contact between the ribbon and the linerless label, as compared to that of near edge printing, reduces the tendency of ink to transfer back to the ribbon.

A corner edge printhead, a hybrid of the near edge and true edge designs, offers similar advantages to those of the true edge printhead. FIG. 4 illustrates a typical corner edge printhead 100 which includes a heat sink 102, a substrate 104, a flex circuit 106, and a driver IC 108 covered by an epoxy overcoat 110 and overlying a solder bump 112.

A corner 113 of an edge 115 of substrate 104 is ground at an angle, typically about 25 degrees. Heated transfer elements 114 are deposited on the grounded corner 113 of the printhead substrate 104. During operation, the thermal transfer ribbon and linerless label material pass over heated transfer elements 114 in the direction of arrows D and E respectively.

As with true edge printheads, corner edge printheads offer a linear material path and a significant reduction in the distance between the point of heat application and the point that the ribbon is stripped away, reducing the tendency of ink to re-cool and not transfer from the ribbon to the silicone coated surface. Examples of commercially available printers useful in printing on linerless labels include TEC B-472 and B-572 printers.

There are, however, problems associated with true edge or corner edge printing on the release layer of linerless labels. Although the ink usually transfers, it has a tendency to smear or scratch off. Applicants have found that the use of certain preferred silicone release materials and resin or wax/resin thermal transfer ribbons enhance the ink transfer and anchorage during corner or true edge printing on the release layer of linerless labels.

Silicone release materials with acrylates as the crosslinking groups exhibit a greater affinity for print receptivity. Silicone formulations based on polydimethyl siloxane (PDMS) cure due to the reaction of a vinyl group with an acrylate added to the PDMS backbone at varying intervals. The acrylate group provides polarity to the molecule, aiding the anchorage of the molecule to the substrate. The body of the chain of most silicones, as opposed to the end, contains the acrylate group. It is believed that during coating of the silicone onto the substrate, the silicone molecule tends to "rotate" during or after coating. The rotation exposes the low surface energy dimethyl groups. The acrylate groups tend to orient towards the paper, improving the bonding or anchorage of the molecule to the paper.

A preferred embodiment of the invention includes a silicone release material of relatively low molecular weight and a relatively high amount of acrylate groups as compared to the PDMS groups. It is believed that this relationship hinders the rotation of the silicone molecule during coating of the silicone release material onto the substrate. As a result, a larger proportion of acrylate groups remain oriented towards the release coating surface, away from the substrate. A significant increase in ink anchorage results.

The present inventors have found that, although blending higher molecular weight silicones with a lower degree of acrylate functionality into the silicone release mixture improves the release properties of the silicone layer, such higher molecular weight silicones hinder ink anchorage. The presence of high levels of methyl groups from PDMS is believed to contaminate the paper surface and prevent sufficient ink anchorage.

The acrylate groups used in the crosslinking may be modified by adding other entities, for example acrylic esters, and still maintain acceptable levels of printability, ink anchorage, and release level. Other conventional materials may also be present in the silicone composition, such as modifying agents, chain extenders, and the likes.

A balance must be achieved for both effective print anchorage and adhesive release. A preferred silicone release coating achieving such a balance during corner or true edge printing on linerless labels is RC-711 UV curable silicone manufactured by Goldschmidt Chemical Corp. of Hopewell, Va. Other suitable mixtures may include the RC-705, RC-706, RC-708, RC-710, and RC-712 silicone coatings and any other silicone coatings with similar characteristics from the same manufacturer.

Goldschmidt RC-711 has the following formula:

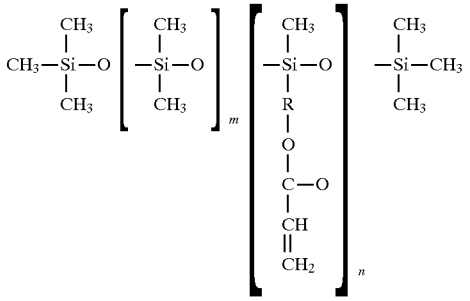

wherein it is believed that m is about 40 and n ranges from about 8 to about 12. It is understood that the repetitive dimethyl and acrylate groups do not necessarily appear grouped together, but may be randomly interspersed within the molecule. The acrylated polydimethyl siloxane is a relatively short chain polymer with high functionality. This material tends to have higher release than some of the less acrylated polymers. It is often used as the tight release component of a silicone mixture. In addition, its high density interchain and intrachain crosslinking, provides enhanced anchorage to the substrate. Also, because of its relatively large proportion of acrylate units relative to PDMS units, the RC-711, when coated onto a substrate, has a large number of acrylate groups oriented toward the surface of the layer, thus providing enhanced ink anchorage.

In addition to the acrylated polydimethyl siloxane, the Goldschmidt RC-711 silicone contains a photoinitiator to assist in curing the composition. The particular photoinitiator in RC-711 is Darocur 1173, which is 2-hydroxy-2-methyl-1-phenyl-1-propanone, available from Ciba Geigy Corp. However, any of those photoinitiators known in the art to be effective in curing polysiloxanes can be used.

The release composition can be cured after coating on the substrate by exposure to uv radiation in a nitrogen-rich atmosphere in which oxygen is preferably maintained at a concentration less than 50 ppm. If the level of oxygen exceeds 50 ppm, complete curing may not be achieved. UV curing can be carried out by, for example, passing the release coated substrate under an "H" type lamp (available from Fusion Systems, Rockville, Md.) at a rate preferably ranging from about 100 fpm to about 700 fpm, more preferably about 300 fpm, and at a wavelength preferably ranging from about 200 to about 350 nm, more preferably closer to about 350 nm. As an alternative to uv curing, electron beam radiation may be used to cure the release composition on the substrate.

As mentioned above, certain thermal transfer ribbons have been found to be particularly effective for corner or true edge printing upon linerless labels. In particular, resin and wax/resin based ribbons, as opposed to the more conventional wax based ribbons, enhance the anchorage of ink to the release coating, providing higher resistance to smearing and scratching off. This is due, in part, to the higher melting points of resin and wax/resin ribbons, as compared to wax ribbons. Typical melting points for inks in thermal transfer ribbons range from between 60° and 100° C., with wax/resin and resin ribbons typically being in the upper half of that range, i.e., melting points between 80° and 100° C.

Faster melting and slower cooling ribbons are preferred, as long as they provide sufficient resistance to smearing and scratching off. Such ribbons provide more molten ink at the point of stripping when using low power settings. Examples of resins used in thermal transfer ribbons include ethylene-vinyl acetate, styrene-acrylate, rosin ester, polystyrene, polyester, acrylics, hydrocarbon resins, vinyl acetate-vinyl chloride, and butyral.

A thermal transfer ribbon basically consists of 4 layers, a backcoating having a thickness of approximately 0.1 $\mu$m, a base film approximately 3.5–6.0 $\mu$m thick, a primer approximately 0.1 $\mu$m thick, and an ink layer having a thickness in the range of about 3.0 to 5.0 $\mu$m. When necessary, a top coating is applied to the ink to promote adhesion to the receiving material.

The backcoating prevents sticking of the polyester film to the printhead, reduces the coefficient of friction, controls ribbon wrinkling, and decreases static electricity. The primer controls ink flaking, defines gloss level, and ensures consistent ink release and image durability.

Commercially available ribbons found to be particularly effective for corner or true edge printing on release layers of linerless labels include Ricoh B-110AF, Iimak's R-2 Prime, and Armor APR-4. Other experimental ribbons, including Iimak's P-3, may also be particularly effective.

The base material of the Ricoh and Iimak ribbons consists of a polyester film. The Ricoh ribbon has a transmission density of more than 1.2, a thermosensitivity of more than 15 mj/mm$^2$, and an image density of more than 1.2. The printhead image has a resistance to smear and heat at temperatures as high as 50° C.

It is to be understood that either a permanent or removable pressure sensitive adhesive can be used in the linerless label that is printed upon by the method of the present invention. Permanent adhesives are the most useful. Commercially available permanent adhesives that have been found to produce a suitable balance between release and high tack to corrugated include Henkel Adhesives HM-6420 and HM-115. Other known permanent adhesives with similar characteristics may also be suitable.

It will be apparent to those skilled in the art that various modifications and variations can be made in the printing method and linerless label of the present invention without departing from the scope or spirit of the invention.

Other embodiments of the invention will be apparent to those skilled in the art from consideration of the specification and practice of the invention disclosed herein. It is intended that the specification be considered as exemplary only, with a true scope and spirit of the invention being indicated by the following claims.

What is claimed is:

1. A method of printing on linerless label material having a substrate with first and second sides, an adhesive layer on the first side of the substrate, and a release layer on the second side of the substrate, said method comprising the steps of:

advancing linerless label material and a thermal transfer ribbon coated with ink through a thermal printer, the thermal printer including a printer substrate supporting a heated transfer element, the printer substrate having a narrow edge surface between two substantially planar surfaces;

moving the thermal transfer ribbon over the heated transfer element of the thermal printer, the heated transfer element being located on the edge surface of the printer substrate;

heating the thermal transfer ribbon to cause the ink to reach a molten or fluid state; and transferring the ink in its molten or fluid state to the release layer of the linerless label material.

2. A method of printing on a linerless label as recited in claim 1, wherein the contact distance between the thermal transfer ribbon and the linerless label material during the step of transferring the ink ranges from about 0.2 to about 0.5 millimeters.

3. A method of printing on linerless label material as recited in claim 1, wherein the thermal transfer ribbon is resin based.

4. A method of printing on linerless label material as recited in claim 1, wherein the thermal transfer ribbon is wax/resin based.

5. A method of printing on linerless label material as recited in claim 1, wherein the ink has a melting point in the range of approximately 80 to 100 degrees Celsius.

6. A method of printing on linerless label material as recited in claim 1, wherein the release layer is a silicone-based composition.

7. A method of printing on linerless label material as recited in claim 1, wherein the release material is an acrylated polydimethyl siloxane having a high proportion of acrylate groups to polydimethyl siloxane groups.

8. A method of printing on linerless label material as recited in claim 7, wherein the acrylated polydimethyl siloxane is crosslinked.

9. A method of printing on linerless label material as recited in claim 8, wherein said crosslinking is interchain and intrachain.

10. A method of printing on linerless label material as recited in claim 8, wherein said crosslinking occurs by exposing the silicone release material to uv light.

11. A method of printing on linerless label material as recited in claim 8, wherein said crosslinking occurs by exposing the silicone release material to electron beam radiation.

12. A method of printing on linerless label material as recited in claim 1, wherein the adhesive is a permanent adhesive.

13. A method of printing on linerless label material as recited in claim 1, wherein the adhesive is a removable adhesive.

14. A method of printing on linerless label material having a substrate with first and second sides, an adhesive layer on the first side of the substrate, and a release layer on the second side of the substrate, said method comprising the steps of:

advancing linerless label material and a thermal transfer ribbon coated with ink through a thermal printer, the thermal printer including a printer substrate supporting a heated transfer element, the printer substrate having a narrow edge surface between two substantially planar surfaces;

moving the thermal transfer ribbon over the heated transfer element of the thermal printer, the heated transfer element being located on a corner of the edge surface of the printer substrate;

heating the thermal transfer ribbon to cause the ink to reach a molten or fluid state; and transferring the ink in its molten or fluid state to the release layer of the linerless label material.

15. A method of printing on linerless label material as recited in claim 14, wherein the contact distance between the thermal transfer ribbon and the linerless label material during the step of transferring the ink ranges from about 0.2 to about 0.5 millimeters.

16. A method of printing on linerless label material as recited in claim 14, wherein the thermal transfer ribbon is resin based.

17. A method of printing on linerless label material as recited in claim 14, wherein the thermal transfer ribbon is wax/resin based.

18. A method of printing on linerless label material as recited in claim 14, wherein the ink has a melting point in the range of approximately 80 to 100 degrees Celsius.

19. A method of printing on linerless label material as recited in 14, wherein the release layer is a silicone-based composition.

20. A method of printing on linerless label material as recited in claim 14, wherein the release material is an acrylated polydimethyl siloxane having a high proportion of acrylate groups to polydimethyl siloxane groups.

21. A method of printing on linerless label material as recited in claim 20, wherein the acrylated polydimethyl siloxane is crosslinked.

22. A method of printing on linerless label material as recited in claim 21, wherein said crosslinking is interchain and intrachain.

23. A method of printing on linerless label material as recited in claim 21, wherein said crosslinking occurs by exposing the silicone release material to uv light.

24. A method of printing on linerless label material as recited in claim 21, wherein said crosslinking occurs by exposing the silicone release material to electron beam radiation.

25. A method of printing on linerless label material as recited in claim 14, wherein the adhesive is a permanent adhesive.

26. A method of printing on linerless label material as recited in claim 14, wherein the adhesive is a removable adhesive.

27. A linerless label including a substrate having first and second sides, an adhesive layer on the first side of the substrate and a silicone release layer on the second side of the substrate, the label being prepared by a process comprising the steps of:

advancing the linerless label and a resin based thermal transfer ribbon coated with ink through a thermal printer, the thermal printer including a printer substrate supporting a heated transfer element, the printer substrate having a narrow edge surface between two substantially planar surfaces;

moving the ribbon and the linerless label over the heated transfer element of the printer, the heated transfer element being on the edge surface of the printer substrate or on a corner of the edge surface of the printer substrate;

heating the ribbon to cause the ink to reach a molten or fluid state; and transferring the ink in its molten or fluid state to the second side of the linerless label.

28. The linerless label as recited in claim 27, wherein the heated transfer element is on the edge surface of the printer substrate.

29. The linerless label as recited in claim 27, wherein the heated transfer element is on a corner of the edge surface of the printer substrate.

30. The linerless label as recited in claim 27, wherein the contact distance between the thermal transfer ribbon and the linerless label material during the step of transferring the ink ranges from about 0.2 to about 0.5 millimeters.

31. The linerless label as recited in claim 27, wherein the ink has a melting point in the range of approximately 80 to 100 degrees Celsius.

32. The linerless label as recited in claim 27, wherein the release layer is a silicone-based composition.

33. The linerless label as recited in claim 27, wherein the release material is an acrylated polydimethyl siloxane having a high proportion of acrylate groups to polydimethyl siloxane groups.

34. The linerless label as recited in claim 33, wherein the acrylated polydimethyl siloxane is crosslinked.

35. The linerless label as recited in claim 34, wherein said crosslinking is interchain and intrachain.

36. The linerless label as recited in claim 34, wherein said crosslinking occurs by exposing the silicone release material to uv light.

37. The linerless label as recited in claim 34, wherein said crosslinking occurs by exposing the silicone release material to electron beam radiation.

38. The linerless label as recited in claim 27, wherein the adhesive is a permanent adhesive.

39. The linerless label as recited in claim 27, wherein the adhesive is a removable adhesive.

* * * * *